United States Patent [19]

Somoza

[11] Patent Number: 5,035,363

[45] Date of Patent: Jul. 30, 1991

[54] ULTRASONIC GRINDING OF EXPLOSIVES

[75] Inventor: Carlos Somoza, Minden, La.

[73] Assignee: Thiokol Corporation, Ogden, Utah

[21] Appl. No.: 549,449

[22] Filed: Jul. 6, 1990

[51] Int. Cl.[5] ..... B02C 19/00

[52] U.S. Cl. ..... 241/1; 241/21; 241/24; 149/92; 149/109.6

[58] Field of Search ..... 241/1, 21, 24; 149/92, 149/109.6; 264/3.4, 3.5, 3.6; 564/107

[56] References Cited

U.S. PATENT DOCUMENTS

| | | | |
|---|---|---|---|
| 2,204,059 | 6/1940 | Acken | 564/107 |
| 3,239,502 | 3/1966 | Lee et al. | 260/583 R |
| 3,351,585 | 11/1967 | Lee et al. | 564/107 |
| 3,600,477 | 8/1971 | Friedel et al. | 241/21 |
| 3,770,721 | 11/1973 | Robbins et al. | 149/92 |
| 4,156,593 | 5/1979 | Tarpley, Jr. | 241/20 |
| 4,572,439 | 2/1986 | Pitzer | 241/21 |
| 4,767,064 | 8/1988 | Resch | 241/21 |

*Primary Examiner*—Stanley Silverman
*Assistant Examiner*—Neil M. McCarthy
*Attorney, Agent, or Firm*—Trask, Britt & Rossa

[57] ABSTRACT

The particle size of energetic explosive materials is reduced by slurrying the particulate explosive materials in an inert liquid such as water or an aqueous solution, and subjecting the slurry to intense acoustic cavitation from an ultrasonic generator for a short time. The particulate explosive materials are rapidly ground to a small particle size while minimizing the danger of detonation.

10 Claims, 3 Drawing Sheets

ULTRASONIC GRINDING OF EXPLOSIVES

BACKGROUND OF THE INVENTION

1. Field of the Invention

This invention relates to size reduction of particles of explosives. More particularly, the invention pertains to an improved method for rapidly and safely grinding explosive materials to a small particle size with reduced variation in particle size distribution.

2. State of the Art

Size reduction of explosive materials has historically been accomplished by either (a) dissolution and recrystallization under carefully controlled conditions, or (b) grinding of the dry explosive. Grinding equipment such as fluid energy mills or jet mills are typically used. These grinders have no moving parts in contact with the material undergoing size reduction. The particles are ground by fluid jets which cause the particles to travel in a "racetrack" course, so that the particle size is reduced by interparticle collision. Alternatively, ball mills or pin mills are used. Nevertheless, the use of fluid-energy mills and other dry grinding methods for explosives is considered to be inherently hazardous. Excessive energy input into a single particle may result in catastrophic detonation. Such high explosives as cyclotrimethylenetrinitramine (RDX) and cyclotetramethylenetetranitramine (HMX) are considered to be too dangerous to be used in the pure form in ammunition. Various desensitizing agents are combined with the explosive materials which enable their use in ammunition and useful detonable products.

Even with insensitive materials such as coal, steam is used as a carrier in production scale fluid-energy mills to minimize the risk of spontaneous combustion and possible explosion.

Wet grinding, i.e. grinding of a slurry of the solid material in an "inert" liquid such as water, is considered to be much less dangerous, because the liquid lubricates the solids and readily absorbs energy.

U.S. Pat. No. 3,239,502 of Lee et al. describes one method currently used for preparing cyclotetramethylenetetranitramine (HMX) of small particle size, i.e. less than 325 mesh. Crude HMX is diluted with a non-solvent liquid such as water, methanol, ethanol or the like. The resultant slurry is recirculated by passage through a piping system including a pump or pumps, and throttling valves or orifices. The recirculating treatment is conducted for a period of at least 10 (ten) hours to gently grind the HMX particles. A cyclone separator is used to separate the desired fines from the larger particles. The latter are returned to the grinding circuit for additional size reduction. The grinding period is very long, typically about 16 hours, and there is considerable batch to batch variation in mean particle size as well as in the distribution of particle size.

More recently, ultrasonic energy has been proposed for size reduction of coal. For example, U.S. Pat. No. 4,156,593 Tarpley Jr. describes the size reduction of coal particles for separating contaminants such as pyrite and clay therefrom. Coal is slurried in an aqueous liquid containing a leaching agent and a penetrant/embrittling agent. Fragmentation in the presence of ultrasonic cavitation is facilitated by the natural porosity of coal.

U.S. Pat. No. 4,410,423 of Walsh describes the use of ultrasonic energy to enhance the acid dissolution of sodium fluoride and cryolite. Alkaline ore containing the sodium fluoride, cryolite, and insoluble alumina is reduced in particle size by dissolution of the fluoride and cryolite. However, the released alumina particles and carbon particles in the slurry are not reduced in size by the ultrasonic treatment.

Generation of an ultrasonic field in liquids may result in cavitation capable of producing high local pressures, i.e. several tens of thousands of atmospheres. It is believed that the gas bubbles which are created have high internal temperatures as well, e.g. 5000 to 10,000 degrees C. Microscopic flames are known to occur in the liquid, and the ultrasonic treatment has been shown to ionize water, degrade organic compounds, melt metals, and erode solid surfaces. Sonification is also known to significantly increase the detonation rates of explosives.

The high explosives RDX and HMX are known to be particularly sensitive to impact, with impact sensitivities of 0.45 and 0.52 kgm, respectively. When the conditions are such that a gas may be adiabatically compressed, with a rapid increase in temperature, and subsequently collapsed, the sensitivity of the explosive material is known to be enhanced. Such conditions are known to exist, and are in fact desirably created, in liquids subjected to ultrasonic generation.

SUMMARY OF THE INVENTION

This invention is a method for grinding solid explosive particles such as energetic nitramines to smaller sizes. In this method, the particles are suspended in a liquid to form a slurry. The slurry is subjected to ultrasonic energy at a frequency or frequencies in the range of about 14–60 KHz. The preferred ultrasonic frequency is in the lower end of the scale, i.e. about 14–30 KHz, where cavitational shock intensity is higher. It may be desirable, however, to utilize the higher frequencies with some explosive materials to reduce the cavitational intensity and avoid detonation.

The slurrying medium is inert, that is, it does not react chemically with the explosive material being ground. Furthermore, it is also a non-solvent as regards the desired explosive material. The slurrying medium, preferably aqueous, may contain additives which react with and/or dissolve contaminants associated with the explosive material. The contaminants, for example may comprise materials found in the crude explosive, including occluded acidity and other undesirable substances.

The method of the invention has demonstrated significant advantages over other methods used to grind explosive materials. Use of ultrasonic grinding is much faster than other methods. Final particle size is easily controlled, and is more uniform than the product of other methods currently in use. In addition, the risk of detonation is believed to be much reduced. The input power is easily controlled to accommodate differences in particle hardness and sensitivity of various explosive materials.

Ultrasonic grinding of wet slurries is generally applicable to solid explosive per se, including those considered to be "high explosive" materials. It has been demonstrated as a method for grinding high explosives cyclotrimethylenetrinitramine (RDX), tetramethylenetetranitramine (HMX) and a mixture of RDX and HMX known as "co-produced explosive" (CPX).

In tests, class 1 RDX in which about 70 percent passed a #325 U.S. Standard sieve was ground to class 5 RDX, in which 97 percent passed the #325 sieve, in a mere 30 minutes. The conventional wet-grinding technique takes more than 10 hours.

Wet sonification of explosive materials in accordance with this invention is particularly advantageous when the final product is to be formulated from wet explosives. The method elminates a drying step as well as the dry grinding step with its attendant hazards.

DESCRIPTION OF THE PREFERRED EMBODIMENTS

Figure 1:
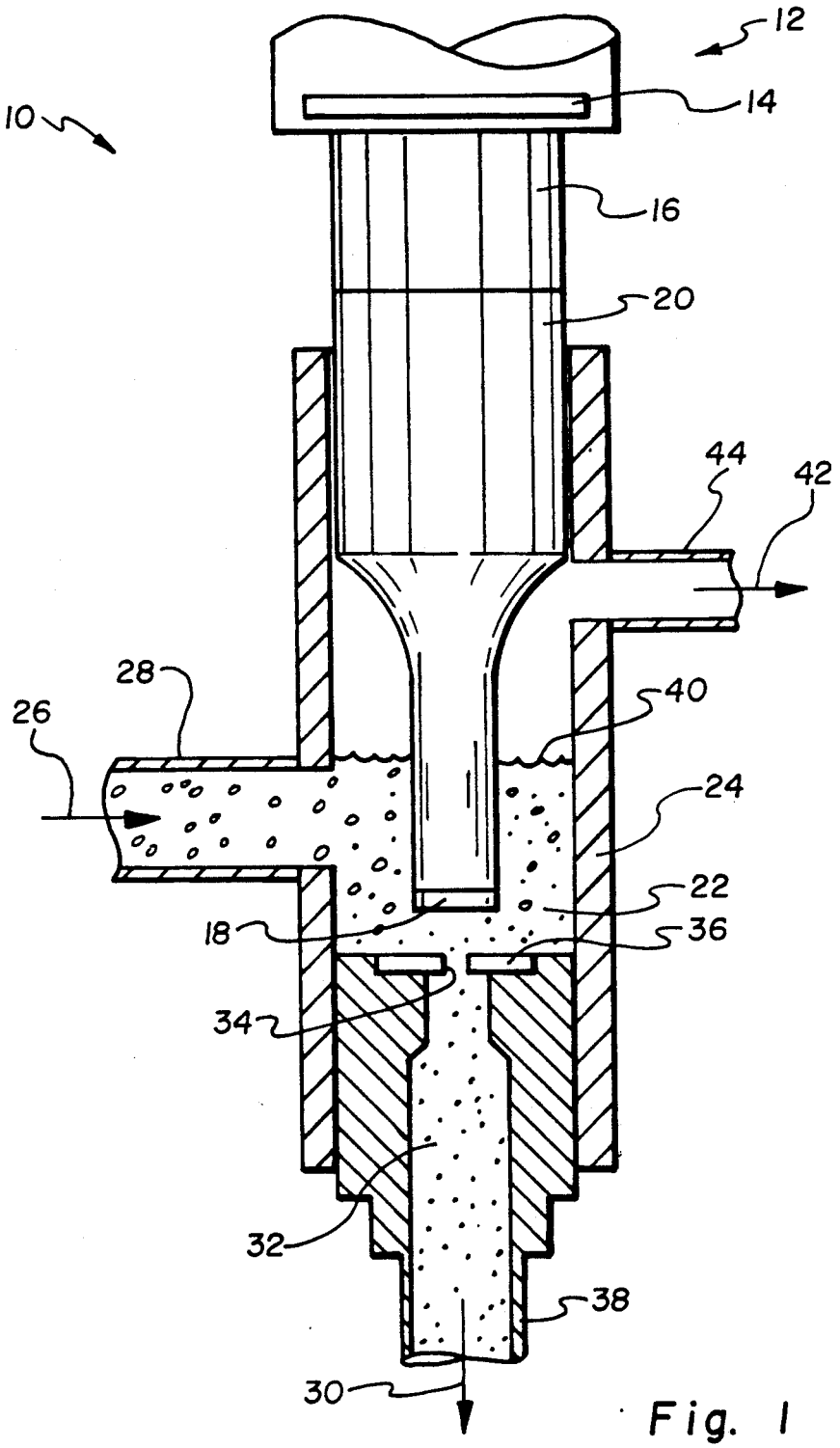
FIG. 1 is a partial sectional view through an ultrasonic energy generating device by which the present invention may be practiced.

FIG. 1 illustrates a typical ultrasonic generating apparatus 10 which may be useful for continous sonic grinding of a particulate explosive material. The sonic generator 12 includes a transducer 14 and sonic converter 16 which convert electrical energy to ultrasonic vibration in the tip 18 of disruptor horn 20. The particular construction and operation of such generators is well known in the art. The disruptor horn 20 is shown submerged in the slurry 22 of particulate explosive material within treatment chamber 24. A stream 26 of slurry 22 is introduced into the treatment chamber 24 from inlet conduit 28. A stream 30 of ground explosive material slurry 32 passes through orifice 34 in orifice plate 36 into outlet conduit 38. The orifice is sized to permit the finely ground particles to pass through, retaining the larger, unground particles to remain in the treatment chamber 24.

If desired, the flowrate of slurry into the treatment chamber 24 may be adjusted to increase the liquid level 40 so that a portion 42 of the slurry overflows from the treatment chamber through overflow conduit 44. It may be recycled for further grinding or used for a different end product.

The tip 18 of the horn 20 is located so that all particles passing into the outlet conduit 38 are subjected to the high intensity ultrasonic field below the tip, where the primary acoustic cavitation occurs. Preferably, the tip 18 is located a maximum distance of about 1.0D from the orifice plate 36, where D is the diameter of the tip 18.

In an alternate continuous treatment method, the treatment chamber 24 has only an inlet located at the bottom of the chamber 24, and an outlet on the side of the chamber 24. Thus, looking at FIG. 1, the flow path is reversed, i.e. the slurry is fed upward through conduit 38 into treatment chamber 24, and the ground slurry passes from the chamber 24 through conduit 28. The particles in the incoming slurry are immediately subjected the acoustic cavitation upon passing upward through orifice 34 into the treatment chamber. In this alternate system, overflow conduit 44 is generally unnecessary, and is removed.

Because of the heat generated by sonification, the treatment apparatus will generally require cooling means, not shown, to prevent the bulk slurry temperature from exceeding a safe limit. For some explosives like HMX, RDX and CPX, the bulk slurry temperature in the ultrasonic treatment chamber is preferably maintained below 50 degrees C. This temperature will vary with the particular explosive material. The cooling means may comprise cooling coils in the treatment chamber walls, or surrounding the walls, or other means known in the art.

Ultrasonic generators in current use generally have a zirconate titanate crystal or transducer for generating large ultrasonic amplitudes with small power inputs at frequencies of about 14–60 KHz. The preferred frequency is between 14 and 30 KHZ, and the most preferred is 14–30 l KHZ. The ultransonic waves travelling through the liquid consist of alternate compressions and rarefactions, which at high amplitude, create acoustic cavitation, i.e. the making and breaking of gas bubbles which abrade and grind the solid particles to smaller sizes. Bubble collapse may create high local pressure of about 20,000 atmospheres if permitted to resonate. The bubble size is greater at the lower frequencies, e.g. 14 -30 KHZ, resulting in greater mechanical shock upon collapse. At higher frequencies such as 1 MHz, the shock intensity is much reduced. Acoustic cavitation may not be possible at frequencies above 2.5 MHz.

The slurry stream 30 passing from the ultrasonic treatment is typically filtered or otherwise treated to separate the ground particulate explosive materials from the inert slurry liquid.

One of the advantages of using ultransonification to grind explosives is that the energy seen by the particles is easily varied to adapt to the particular grinding and safety requirements. The treatment may be varied by changing the generator power, by changing the particular slurry medium, by changing the slurry temperature, or by changing the frequency. All of these factors are known to affect the intensity of cavitational forces in ultrasonification. Thus, the changing sensitivity of an explosive material due to particle size may be compensated for during the grinding process, if necessary.

The ultrasonic power intensity useful in this invention is expected to vary widely, depending upon the sensitivity of the explosive, the particular slurry medium used, and other factors. It is expected that for most explosives, the most useful range of power intensities is from about 70 to about 120 watts/square cm. of tip area, but more generally greater than 70 watts/square cm.

EXAMPLE

Figure 2:
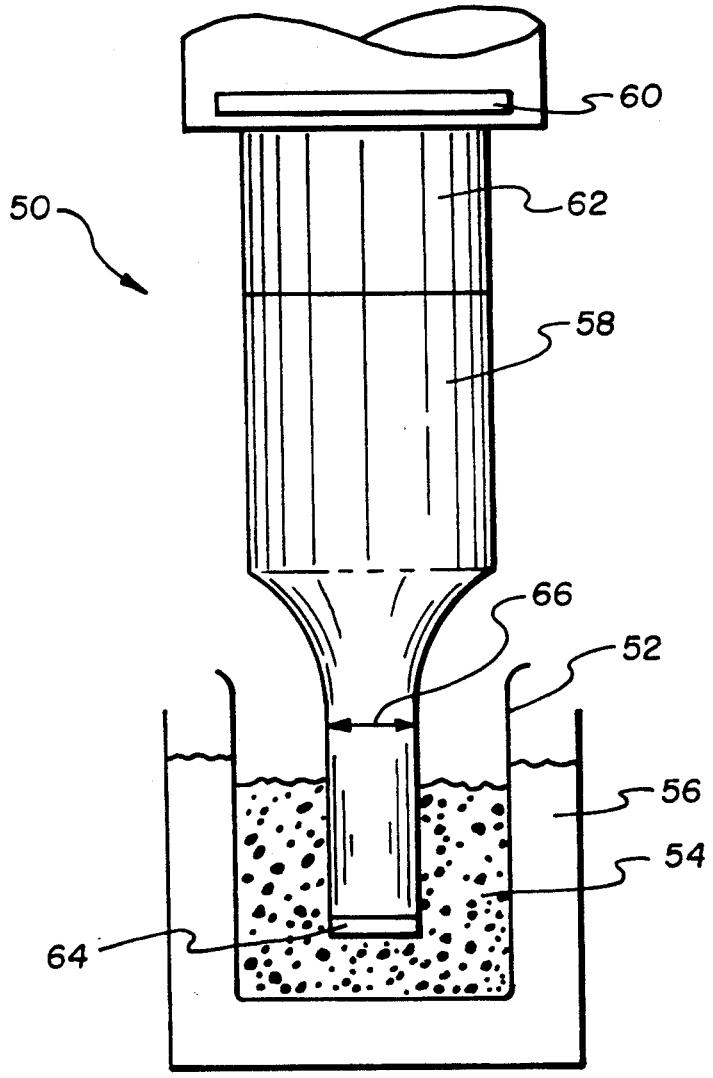
FIG. 2 is a schematic view of the ultrasonic apparatus used in the tests described herein.

As depicted in FIG. 2, a Heat Systems-Ultrasonics Inc. Sonicator model no W385 ultrasonic generation probe 50 was set up for batch treatment of aqueous slurries of explosive materials. The treatment chamber was a beaker 52 containing the slurry 54, placed in an ice/water bath 56 to keep the bulk slurry temperature below 40 degrees C. The mechanical transformer 58, i.e. horn of the Sonicator ultrasonic generator was placed in the beaker and operated for a given period of time, i.e. 5, 10, 20 or 30 minutes. The tranducer 60 operated through the sonic converter 62 to produce a frequency of 20 KHz and maximum input power of 385 watts. The generator had a pulsating head 64 with a diameter 66 of 0.5 inch and a head area of 0.196 square inches (1.267 square cm.). While the power input was set at maximum for all tests, the output power intensity ranged from about 70 to 120 watts per square centimeter tip area, depending upon the particular slurry medium.

Particulate melamine was first chosen to test the theory, since it has approximately the same hardness as RDX, without being energetic, i.e. explosive. Samples of 10 grams of particulate melamine (26.0% passing a No. 325 U. S. Standard sieve) were each slurried in 30 g of water and subjected to batch sonification at 20 KHz frequency for a period of 5, 10, 20, or 30 minutes. The resulting ground slurries were each evaluated for particle size, in terms of percent of mass which passes the No. 325 U.S. Standard (44 micron) sieve. The results were as follows:

PERCENTAGE OF PARTICLE MASS PASSING A NO. 325 U.S. SIEVE

| | Sonification Time, Minutes | | | | |
|---|---|---|---|---|---|
| Particulate Material | None | 5 | 10 | 20 | 30 |
| Melamine | 26.0 | 60.3 | 76.3 | 90.6 | 97.2 |
| RDX | 10.8 | 74.9 | 79.7 | 92.3 | 97.2 |
| CPX | 72.1 | 94.3 | 96.4 | 98.7 | 99.3 |

Figure 3:
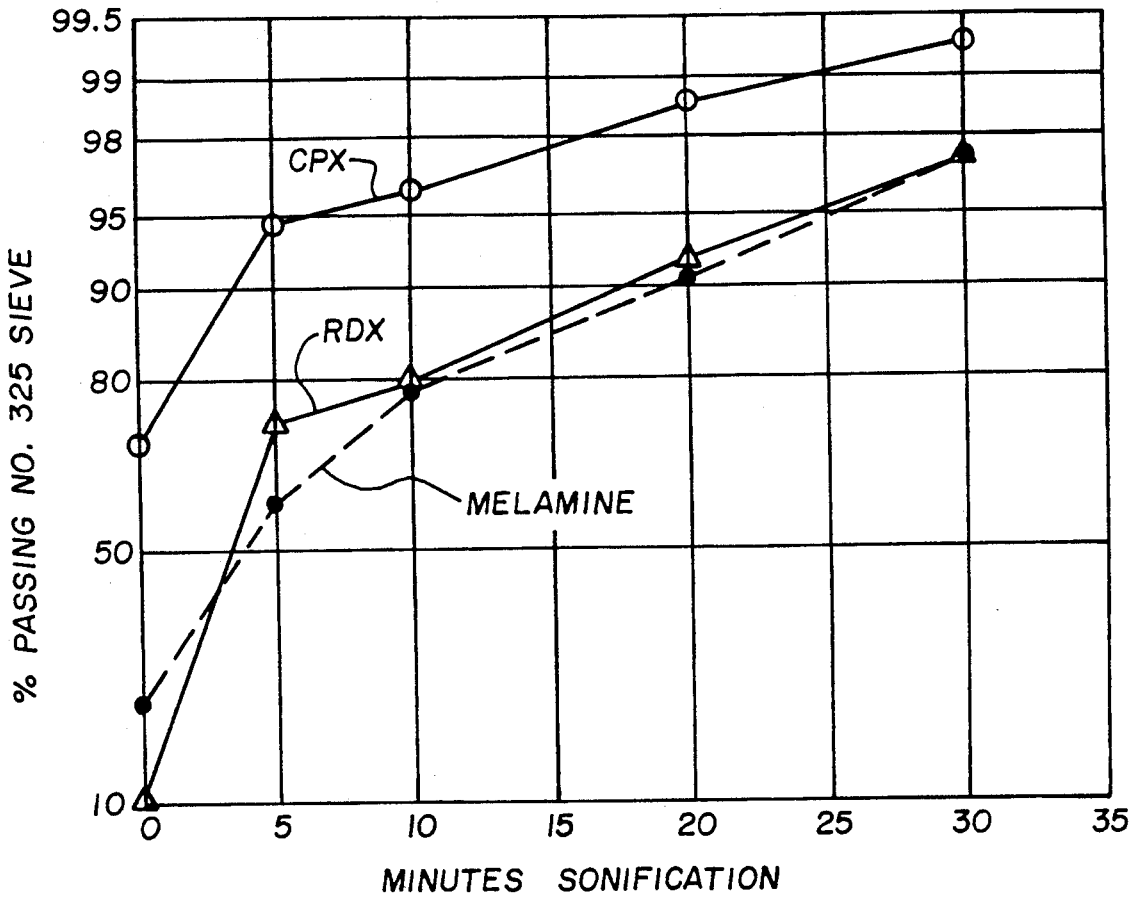
FIG. 3 is a graphical representation of the resulting particle size from grinding slurried samples of particulate melamine, RDX and CPX for various periods of time.

The results are also presented in FIG. 3, and indicate that rapid size reduction was achieved by sonification under these conditions. For example, the rate of grinding the RDX and CPX was much faster than is achieved by recirculation of the slurry in a piping system, as used in the prior art. Detonation was not experienced in any of the tests, although conducted at what are considered to be high power intensities. The rapid rate of particle size reduction at these power intensities indicates that lower power intensities could also be used for explosive grinding, althoush the grinding rate is expected to be somewhat lower. Thus, an explosive material which is ultrasensitive may be ground at a somewhat lower power intensity to avoid any possibility of detonation.

Reference herein to details of the illustrated embodiments is not intended to restrict the scope of the appended claims which themselves recite those features which are regarded as important to the invention.

What is claimed is:

1. A method for reducing the particle size of particulate explosive material, comprising:

adding said particulate explosive material to an inert liquid to form a slurry thereof; subjecting said slurrry to treatment proximate an ultrasonic generator wherein acoustic cavitation in said inert liquid abrades and grinds said particulate explosive material to a reduced particle size, without detonation thereof; and separating said particulate explosive material of reduced particle size from said inert liquid.

2. The method of claim 1, wherein said inert liquid is water or an aqueous solution.

3. The method of claim 1, wherein said ultrasonic generator is operated at a frequency of 14–60 KHz.

4. The method of claim 1, wherein said ultrasonic generator is operated at a frequency of 14–30 KHz.

5. The method of claim 1, wherein said ultrasonic generator is operated at a power output intensity of at least 70 watts/square centimeter of generator tip area.

6. The method of claim 1, wherein said ultrasonic generator is operated at a power output intensity of 70 to 120 watts per square centimeter of generator tip area.

7. The method of claim 1, wherein said aqueous liquid includes an additive for increasing the grinding rate.

8. The method of claim 1, comprising the further step of cooling said slurry before and/or during said passage proximate and ultrasonic generator to maintain a temperature below 50 degrees C.

9. The method of claim 1, wherein said explosive material comprises RDX, HMX, or CPX.

10. A method for reducing the particle size of a particulate explosive material, comprising:

adding said particulate explosive material to an inert aqueous liquid to form a slurry thereof;

passing said slurry in a continuous stream past an ultrasonic generator wherein acoustic cavitation in said inert aqueous liquid abrades and grinds said particulate explosive material to a reduced particle size without detonation thereof;

discharging a stream of said particulate material of reduced particle size to a separation means; and separating said particulate material of reduced particle size from said inert aqueous liquid.

* * * * *